US005417401A

United States Patent [19]

Thompson et al.

[11] Patent Number: 5,417,401

[45] Date of Patent: May 23, 1995

[54] ONE-PIECE MOTOR MOUNT FOR USE IN AN AIR CONDITIONER

[75] Inventors: Christopher M. Thompson, Smyrna; Timothy J. Campbell, Nashville; Billy P. Gipson, Marshall County, all of Tenn.

[73] Assignee: Whirlpool Corporation, Benton Harbor, Mich.

[21] Appl. No.: 65,751

[22] Filed: May 24, 1993

Related U.S. Application Data

[62] Division of Ser. No. 785,473, Oct. 31, 1991, Pat. No. 5,222,374, which is a division of Ser. No. 522,180, May 11, 1990, Pat. No. 5,081,849.

[51] Int. Cl.[6] ..... F16M 7/00

[52] U.S. Cl. ..... 248/674; 248/300

[58] Field of Search ..... 248/671, 674, 675, 201, 248/300, 146

[56] References Cited

U.S. PATENT DOCUMENTS

| | | | |
|---|---|---|---|
| Re. 31,525 | 2/1984 | Boyd, Jr. et al. . | |
| 2,074,136 | 3/1937 | Welch . | |
| 2,598,836 | 6/1952 | Scheele . | |
| 2,662,988 | 12/1953 | McKim | 248/674 X |
| 2,684,825 | 7/1954 | Laviana et al. . | |
| 2,810,536 | 10/1957 | Cunningham . | |
| 2,885,142 | 5/1959 | Eberhart . | |
| 2,952,997 | 9/1960 | Mullin . | |
| 3,145,960 | 8/1964 | Langdon . | |
| 3,516,627 | 6/1970 | Gable et al. . | |
| 3,783,637 | 1/1974 | Woods . | |
| 3,983,429 | 9/1976 | Allardice, Jr. . | |
| 4,033,531 | 7/1977 | Levine . | |
| 4,100,764 | 7/1978 | Murano . | |
| 4,240,264 | 12/1980 | Nakada et al. . | |
| 4,441,684 | 4/1984 | Credle, Jr. . | |
| 4,492,357 | 1/1985 | Morrill | 248/674 |
| 4,800,735 | 1/1989 | Lang et al. . | |
| 5,290,005 | 3/1994 | Akiyama et al. | 248/300 X |

*Primary Examiner*—Ramon O. Ramirez
*Assistant Examiner*—Derek J. Berger
*Attorney, Agent, or Firm*—Hill, Steadman & Simpson

[57] ABSTRACT

A room air conditioner which is easily assembled by virtue of a base pan having a plurality of vertically oriented fasteners secured thereto for retaining various components of the air conditioner including the compressor, condenser assembly, evaporator assembly and a barrier wall. A novel motor mount is provided which is also secured to a plurality of the vertically oriented fasteners of the base pan. A separate control box assembly is secured to the evaporator assembly via vertically oriented fasteners and is kept clear of any air flow path through the air conditioner.

15 Claims, 5 Drawing Sheets

FIG. 2
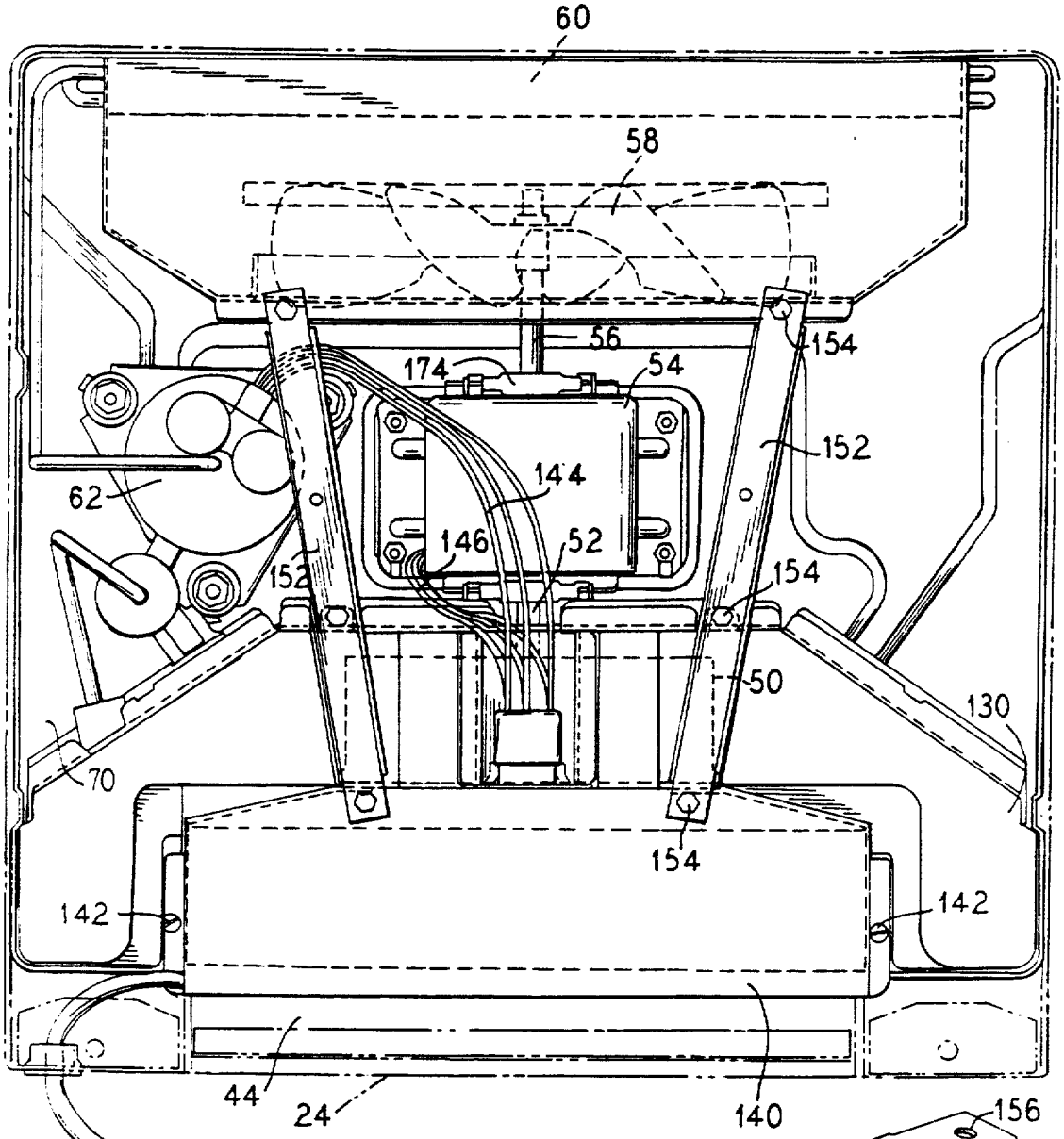
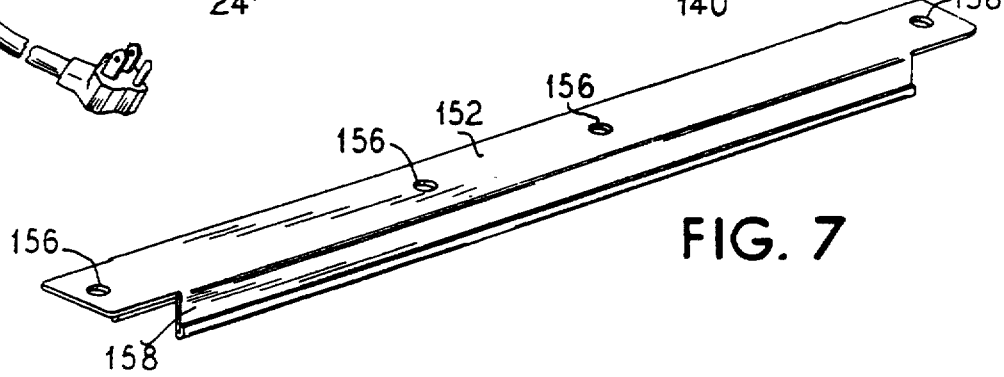
FIG. 7

ONE-PIECE MOTOR MOUNT FOR USE IN AN AIR CONDITIONER

This is a division of application Ser. No. 07/785,473, filed Oct. 31, 1991, now U.S. Pat. No. 5,222,374, which was a division of application Ser. No. 07/522,180, filed May 11, 1990, issued Jan. 21, 1992, as U.S. Pat. No. 5,081,849.

BACKGROUND OF THE INVENTION

The invention is directed to a room air conditioner and more particularly to an assembly method and construction of an air conditioner.

Room air conditioners generally comprise an air inlet fan or blower which is powered by a motor to draw air in through an evaporator coil to be cooled and to direct the cooled air back into the room. Also, such air conditioners include a condenser coil for dissipating the heat picked up by the evaporator coil and a second fan or blower is provided to cause an air flow over the condenser coil to increase the heat dissipation of that coil. A compressor is provided to charge the pressure of a refrigerant which is then supplied to the evaporator coil for evaporation and thus cooling.

Such an arrangement is shown generally in U.S. Pat. No. 3,158,005, assigned to the assignee of the present invention.

Additional features of a room air conditioner generally include a partition wall separating the evaporator coil from the condenser coil so as to maintain one side of the air conditioner as a "cool" side and another side of the air conditioner as a "hot" side.

Due to the complexity in number of parts associated with a room air conditioner, assembly of such a device oftentimes includes complicated and time intensive assembly steps and requires intricate manipulation of parts and tools. Such a process results in an increased cost of the room air conditioner due to increased manufacturing cost.

One attempt to reduce the complexity of assembly of a room air conditioner is shown in U.S. Pat. No. 4,800,735 which illustrates that a motor mounting bracket assembly is provided in two major parts with four connecting fasteners. One of the motor mount assembly sections is secured to a base pan by vertically oriented screws and the other part of the assembly is secured to the first part by four horizontally oriented screws which extend through a slot in the first member to permit variation in the length of the motor mount assembly.

After the motor mount assembly has been secured to the base pan and properly adjusted for its desired length between its end walls, another assembly is brought to the partially assembled air conditioner unit. This further assembly comprises a motor having a blower wheel attached at one end and a fan blade and fan shroud are carried at an opposite end of the motor shaft. This entire assembly is then set down into the partially assembled air conditioner with the drive shaft between the motor and the evaporator blower sliding through a vertical slot in the barrier wall dividing the hot and cold sides of the air conditioner. A separate piece comprising a filler block is then required to be attached to the barrier wall to fill in the vertical slot once the motor has been secured to the motor mount.

The method of assembling the barrier wall to the base pan is not disclosed. The method of assembly of the fan shroud to the condenser coil appears to be through the use of horizontally oriented threaded fasteners extending through a vertical flange of the fan shroud. Thus, the assembly operators are required to manipulate numerous fasteners of individual piece parts by attaching threaded fasteners both in a horizontal and in a vertical orientation during assembly. With this large number of parts and differing orientations of fasteners, the assembly method remains complex.

Another component of a room air conditioner is the electrical control panel which generally includes control buttons or knobs for controlling fan speed, temperature and position of various movable doors such as exhaust doors or fresh air inlet doors. The latter control knob generally comprises a mechanical connection and not an electrical connection. The electrical controls are connected both to the motor as well as to the compressor and further are connected to a source of electric power for the air conditioner. U.S. Pat. No. 2,952,997 discloses a unitary control panel wherein the electrical components are carried in a housing forming an air flow path between the room being cooled and the compressor compartment. Individual terminals are provided on the end of each wire from the motor and compressor that is to be connected to the control panel.

Thus, the complexities in wiring of the control panel to the various components poses a further manufacturing complexity adding to the cost of the air conditioner.

SUMMARY OF THE INVENTION

It is therefore an object of the present invention to provide an air conditioner whose assembly is greatly reduced in complexity.

It is a further object of the invention to provide an air conditioner construction in which a minimal number of components are required to be assembled.

It is a further object of the invention to provide a room air conditioner in which assembly of the vast majority of the components is accomplished through the use of fasteners arranged in a vertical orientation.

It is a further object of the invention to provide a room air conditioner in which mounting of the motor is accomplished quickly and easily with a minimum number of fastening steps.

It is a further object of the invention to provide a room air conditioner in which the various components are secured together within a closely controlled tolerance range.

It is a further object of the invention to provide a room air conditioner in which the air flow to the condenser coil is not blocked or restricted by the motor mount.

It is a further object of the invention to provide a room air conditioner in which the electrical control panel is isolated from any air flow path and may be quickly and easily connected to the remainder of the air conditioner assembly.

These and other objects are accomplished by providing a room air conditioner which is constructed on a base plate having a number of threaded studs preassembled to the base plate onto which various components of the air conditioner will be secured. Specifically, mounting studs are secured to the base plate to project upwardly and various sub-assembly components such as the barrier wall, the motor mount, the compressor and the condenser shroud, through the use of apertured horizontal bottom flanges receive the upwardly projecting studs permitting the assembly operator to attach fastening nuts in an unobstructed vertical orientation to locate and secure those components to the base pan. The evaporator attaches to the base pan with vertically oriented fasteners. The control assembly, which is a separate closed box, attaches to the top of the evaporator with vertically oriented fasteners. The motor mount comprises a specially configured one piece element which receives the motor in a known manner. The motor is secured to the motor mount by a pair of spring clips accessed from above.

Securing straps extend between the condenser shroud, barrier wall and control assembly to stabilize and secure those components in a fixed and precise relative orientation so as to maintain a close tolerance between the parts. This is necessary in that to increase efficiency of the air conditioner unit, close tolerances are required in the spacing of the evaporator blower and condenser fan relative to their respective housings. The straps similarly are secured to those components through vertically oriented fasteners.

The control assembly containing the electrical control knobs and other electrical components such as capacitors and switches is isolated from any air flow and is electrically connected to the motor and compressor through use of a quick connect plug, one part of which is secured to the control assembly and the other part of which is secured to an end of a wiring harness leading to the fan and compressor motors. In this manner all of the electrical controls can be pretested prior to assembly into the air conditioning unit thus greatly increasing the reliability of the air conditioner unit upon complete assembly and reducing the quality control checks at the end of assembly.

BRIEF DESCRIPTION OF THE DRAWINGS

FIG. 2 is a top elevational view of the air conditioner of FIG. 1 with the exterior shroud removed.

FIG. 7 is a perspective view of the securing strap.

DESCRIPTION OF THE PREFERRED EMBODIMENTS

Figure 1:
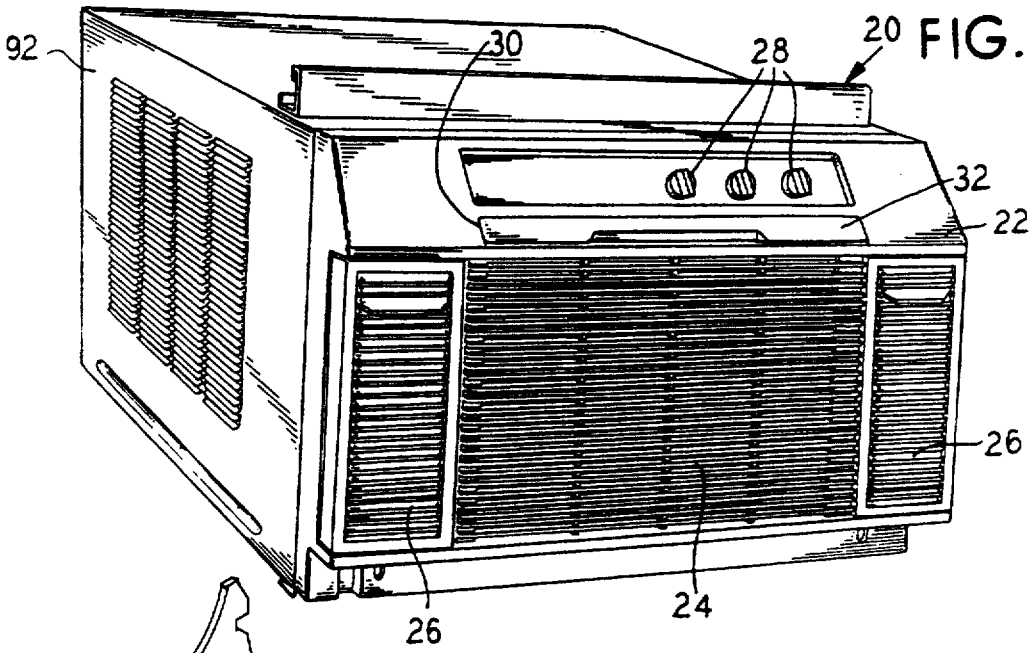
FIG. 1 is a perspective view of a room air conditioner embodying the principles of the present invention.
Figure 5:
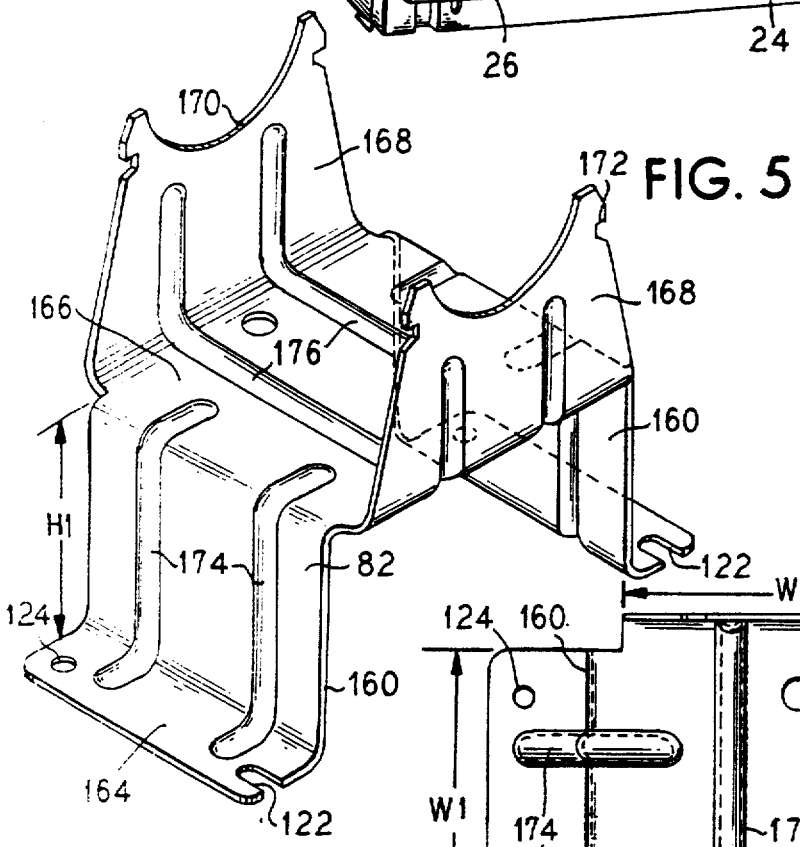
FIG. 5 is a perspective view of the single piece motor mount.
Figure 6:
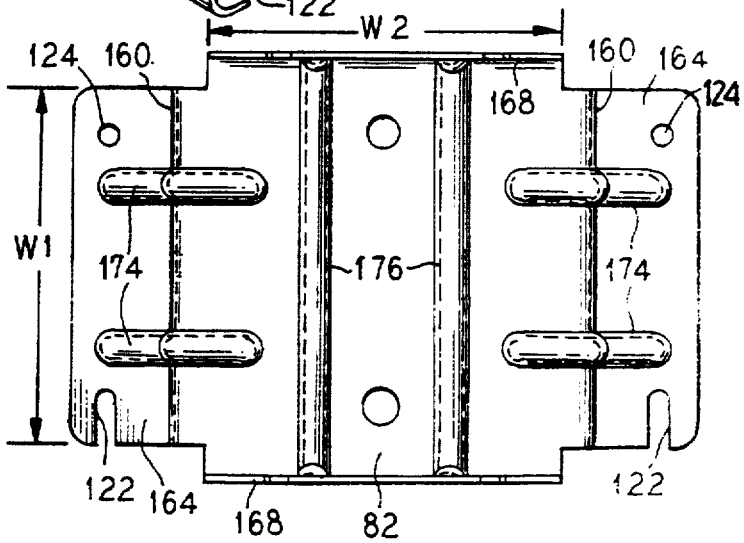
FIG. 6 is a plan view of the motor mount.

FIG. 1 illustrates an air conditioner generally at 20 which embodies the principles of the present invention. The air conditioner has a front panel 22 which faces the interior of a room to be cooled when the air conditioner unit is placed in an open window or in a through the wall sleeve. A central portion 24 of the panel constitutes an air inlet grill through which air flows into a portion of the air conditioning unit. The air is returned to the room through a pair of laterally spaced outlet grills 26. A particular preferred outlet grill construction is described in greater detail in U.S. Pat. No. 5,046,406 entitled "Adjustable Louvers Assembly for a Room Air Conditioner" which disclosure is incorporated herein by reference. The outlet grills 26 are independently controllable by the user and contain louvers that are pivotable about both a vertical and horizontal axis giving the user a wide range of air flow configurations. The control of the air flow leaving the air conditioner is described in greater detail in U.S. Pat. No. 5,065,596 entitled "Dual Louvered Side Air Discharge Openings for Room Air Conditioner" which disclosure is incorporated herein by reference.

Plurality of controls 28 are provided on a control panel area above the inlet grill. Positioned above the inlet grill 24 and below the controls is a slot 30 within which is received an air filter element 32. The placement of the filter 32 causes the filter element to be readily accessible from the exterior of the air conditioner cabinet and does not require removal of any portions of the air conditioner cabinet in order for the filter to be removed to determine whether it needs to be cleaned. Replacement of the filter element is just as easy, that is by sliding the filter element 32 into the slot 30. A particular filter arrangement is described in greater detail in U.S. Pat. No. 5,065,597 entitled "Dual Side Discharge Air Housing for Room Air Conditioner " which disclosure is incorporated herein by reference.

Figure 3:
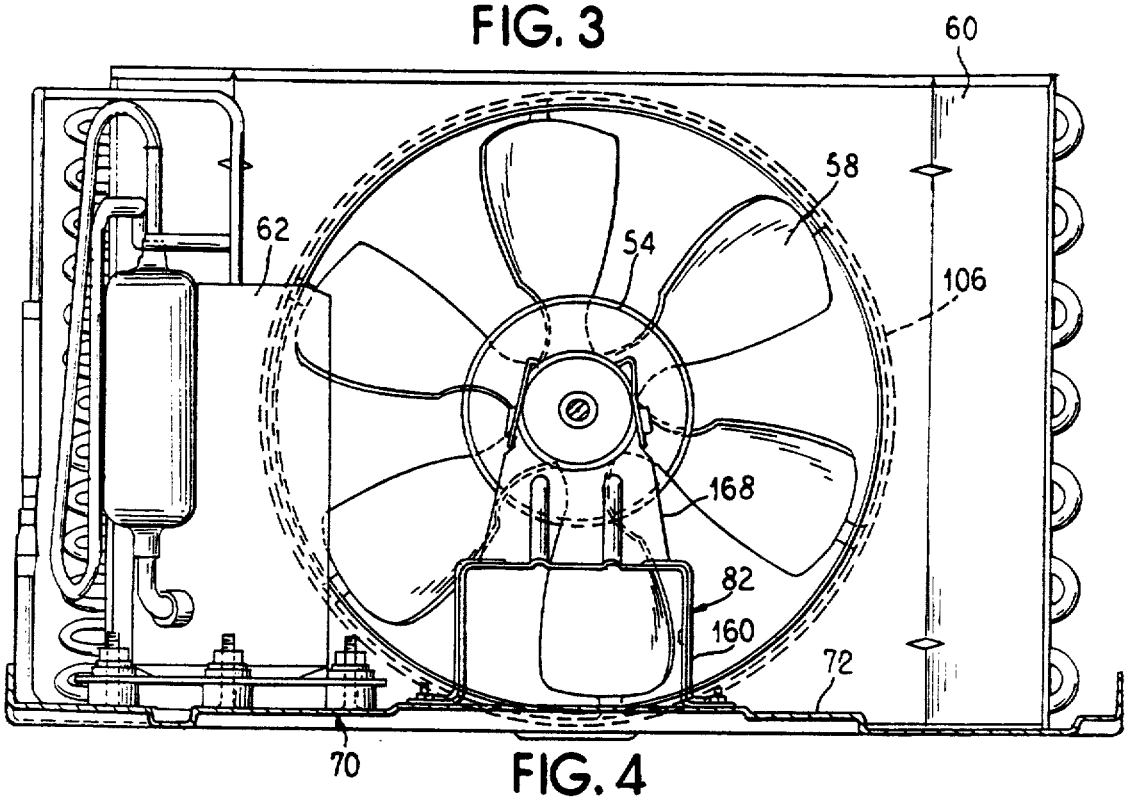
FIG. 3 is a sectional view toward the rear of the air conditioner of FIG. 2 taken generally along the barrier wall.
Figure 4:
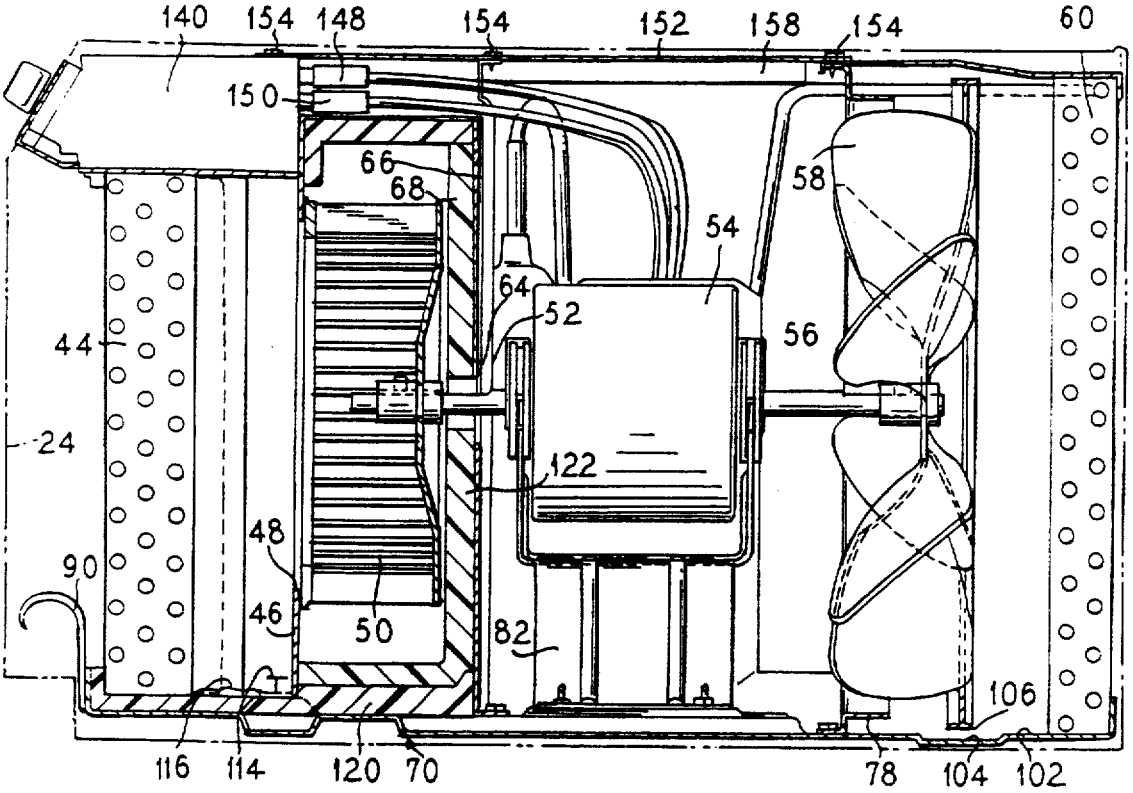
FIG. 4 is a side sectional view of the air conditioner taken generally along the axis of the motor.

The internal components of the air conditioner are shown in greater detail in FIGS. 2–4 and in these views the symmetrical nature of the air conditioner construction and symmetrical nature of the air flow is quite evident. Directly behind the front inlet grill 24 is located the evaporator 44 which is mounted within a sheet metal shroud or housing 46. The housing 46 has a central rear opening 48 which is positioned directly in front of an air moving device, preferably a blower wheel 50. The blower wheel 50 is mounted on a forwardly extending drive shaft 52 of an electric motor 54. The motor 54 also has a rearwardly extending drive shaft 56 to which a fan blade 58 is mounted. The drive shafts 52, 56 extend along the center line of the air conditioner. Directly behind the fan blade is the condenser coil 60. A compressor 62 is provided as is known in the art.

The forwardly extending drive shaft 52 extends through an opening 64 in a barrier wall 66 provided between the blower wheel 50 and the motor 52. The barrier wall 66 separates the cold side of the air conditioner (forward of the wall). This is desirable to prevent air which has been chilled by passing through the evaporator 44 from being inadvertently discharged through the rear of the air conditioner and to prevent hot air in the condenser and compressor portion of the air conditioner from being inadvertently drawn into the cold portion of the air conditioner. A barrier of expanded polystyrene 68 is provided along the barrier wall 66 which provides an insulation against heat transfer.

Figure 8:
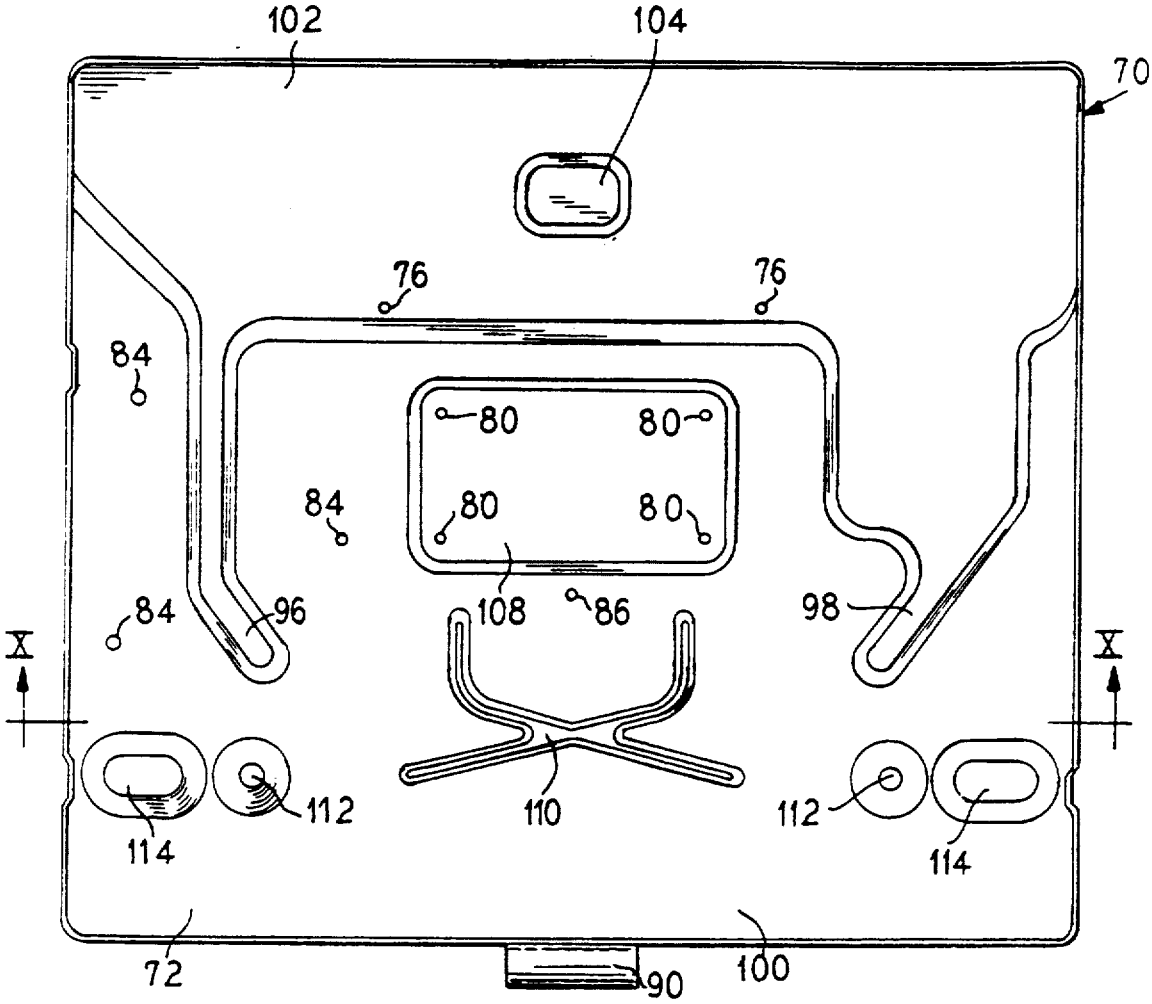
FIG. 8 is a plan view of the base pan.
Figure 9:
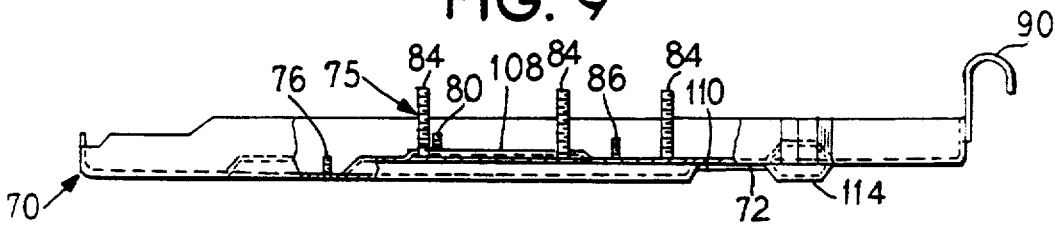
FIG. 9 is a side elevation view, partially cut away, of the base pan of FIG. 8.
Figure 10:
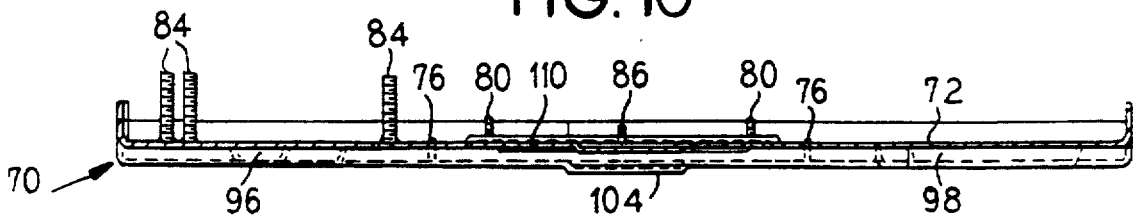
FIG. 10 is a section view of the base pan taken generally along the line X—X of FIG. 8.

A base pan assembly 70 is provided as a mounting platform for a large number of the components of the room air conditioner. The base pan assembly 70 is shown in isolated detail in FIGS. 8–10. In those figures it is clearly illustrated that the base pan assembly 70 comprises the assembly of a contoured base pan sheet 72 and a number of vertically oriented fastening means 75 such as threaded studs. Preferably, the studs are permanently secured to the base sheet 72 by appropriate fastening means such as metal cinching. Specifically there are provided two upwardly projecting studs 76 to be used in securing a condenser shroud 78, four studs 80 for securing a motor mount 82, three studs 84 for securing the compressor 62 and one stud 86 for securing the barrier wall 66.

The base pan assembly 70 also includes a hand grip portion 90 secured to a front edge thereof which assists a user in moving the assembled air conditioner in and out of a protective outer sheath 92 (FIG. 1).

The base pan sheet 72 contains a number of contoured areas which provide various functions. A left side channel 96 and a right side channel 98 are depressed below the elevation of a forward bottom wall portion 100 of the base pan sheet 70. These channels lead rearwardly to a depressed rearward reservoir area 102 and serve to receive and direct collected condensate which has dripped from the evaporator coils 44. A further depression 104 in the reservoir area 102 acts as a well or sump to collect condensate in the specific area to be picked up by a slinger ring 106 (FIG. 4) carried by the condenser fan 58. In a known manner, the slinger ring 106 will pick up condensate collected in the well 104 and will cause it to be flung against the condenser coil to assist in the cooling of the condenser coil and to assist in removal of condensate from the air conditioner.

A central raised boss portion 108 is provided as a mounting platform for the motor mount 82. This relatively small mounting platform within the larger base pan sheet 72 assist in providing stability and rigidity to the mounting of the motor which is critical as will be discussed below. A strengthening boss 110 is formed in the base pan just forward of the motor mounting platform 108. A pair of laterally spaced upwardly projecting bosses 112 are provided as mounting points for the evaporator housing 46. Vertically oriented threaded fasteners 114 captured in a flange 116 of the evaporator are secured into these bosses 112 during assembly.

Downwardly extending bosses 114 are provided to act as feet near the forward portion of the base pan sheet 72 and which have a lower surface which is flush with the lower surface of the reservoir portion 102.

During assembly of the air conditioner, the compressor 62 and the barrier wall 66 are first attached to the base pan sheet 72 by aligning apertures in feet or horizontal flanges with the appropriate fasteners and applying locking nuts in a vertically accessed manner. A bottom insulation panel 120 and the rear insulation panel 122, forming part of the insulation barrier 68 are also placed into the assembly. The expanded polystyrene wall is shown and described in greater detail in U.S. Pat. Ser. No. 5,085,056 entitled "Dual Side Discharge Room Air Conditioner with Foamed Insulation Air Passage Walls" which disclosure is incorporated herein by reference. Next the motor 54 which is already assembled to the motor mount 82 is inserted into the assembly. The blower wheel 50 is not yet attached to the shaft 52 and thus the shaft is guided in through the opening 64 in the barrier wall at a slight angle relative to horizontal. Open slots 122 in the motor mount 82 slide onto the forward studs 80 and then the motor mount 82 can be pivoted down onto the platform 108 such that the rear etude 80 project through openings 124 in the motor mount. Retaining nuts then are applied to secure the bracket 82 to the base pan sheet 72.

Subsequently the shroud 78 for the condenser fan is secured onto the studs 76. The blower wheel 50 and the fan 58 are attached to the shafts 52 and 56, respectively and than the evaporator 44 and condenser 60 are attached to the assembly. The evaporator housing 46 has a horizontal flange 116 through which the fastener 114 is secured to the base (FIG. 4). The evaporator 44 is secured to the housing 46 through the use of a pair of horizontally oriented fasteners on each side and similarly the condenser 60 is secured to the housing 78 through a pair of horizontally oriented fasteners on each side. The barrier wall 66 is also secured at each lateral side to the base pan sheet 72 through a single horizontal fastener 130 on each side. Thus, there are only seven horizontally aligned fasteners on each side of the air conditioner assembly which are required during the final assembly process of the components to the base pan assembly 70.

The control assembly 140 is secured to the evaporator through a pair of vertically oriented fasteners 142 and a wiring harness 144 extending from the compressor and a second wiring harness 146 extending from the motor each terminate in a separate plug 148, 150 respectively which connect into sockets in the rear side of the control assembly 140.

Finally, a pair of securing straps 152 are used to precisely align the component parts as well as providing structural support for the air conditioner by attaching to the condenser housing, the barrier wall 66 and the control assembly 140 by means of vertically oriented fasteners 154. The securing strap 152 is shown in greater detail in FIG. 7 where it is seen that the strap has a series of openings 156 therein for receipt of the fasteners, which openings are positioned such that the strap is symmetrical and can be used in either a forward or backward orientation. Thus, the speed of assembly is increased since the operator does not need to specifically orient to part. A pair of side legs 158 extend downwardly from the strap to provide strengthening for the strap and permit the straps to be used for lifting the air conditioner.

The motor mount 82 is comprised of a pair of spaced apart, relatively vertically oriented leg portions 160, each leg portion having a broad width W1 and a fixed height H1. A foot portion 164 is formed at a bottom end of each leg portion 160. The foot portions extend horizontally outwardly from the legs and have the openings 122, 124 formed therethrough for receiving the fasteners 80 projecting from the base pan assembly 70. A horizontally oriented saddle portion connects a top end of each of the leg members 162. A pair of spaced apart, vertically oriented arm portions 168 extend upwardly from the saddle portion 166. Each arm portion has a broad width W2 which is oriented perpendicular to the width W1 of the leg portions. Also, each arm portion 168 forms an upwardly opening yoke 170 at a top end thereof. The yoke is designed to receive a collar formed on the motor as is known in the art and the yoke includes notched ears 172 for retaining spring clips 174 (FIG. 2) as is known in the art. The entire motor mount assembly is formed of a single piece of material, preferably being stamped from a single metal sheet. Further, during the stamping process, it is preferred to include strengthening bosses 174 which extend from the foot portion, up the leg portion and onto the saddle portion as well as strengthening bosses 176 which extend along the saddle portion and upwardly along each of the arm portions.

It is very important that the motor 54 be held rigidly relative to the condenser housing 78 and the evaporator housing 46 so that a very small clearance can be provided between the housings and the fan and blower wheel. By maintaining small tolerances between the parts, the efficiency of the air conditioner is improved since there is a resulting reduction in air leakages. Therefore, it is critical that the motor mount not only be formed in precise dimensions but that it retain its shape despite sudden acceleration and deceleration of various components of the air conditioner, for example in the event that the air conditioner is dropped or severely bumped during use. Because of these requirements Applicants have found that the height H1 of the legs as well as the height of the arms should be kept at a minimum, thus preventing the use of a single U-piece member having only arms extending upwardly from the base pan. By reducing the height of the arms and legs, the available moment arm for twisting and bending is kept at a minimum. However, it is necessary to elevate the motor due to the clearance required for the fan blades and thus Applicants have determined that making the height of the legs and the height of the arms approximately equal results in a satisfactorily stable mount. Further, by providing the reduced area platform 108 for mounting of the motor mount enhances the stability of a motor. Further, by providing the legs 160 perpendicular to the arms 168, an unobstructed air flow path is provided beneath the motor 54 into the area of the condenser fan 58 as shown in FIG. 3.

Figure 11:
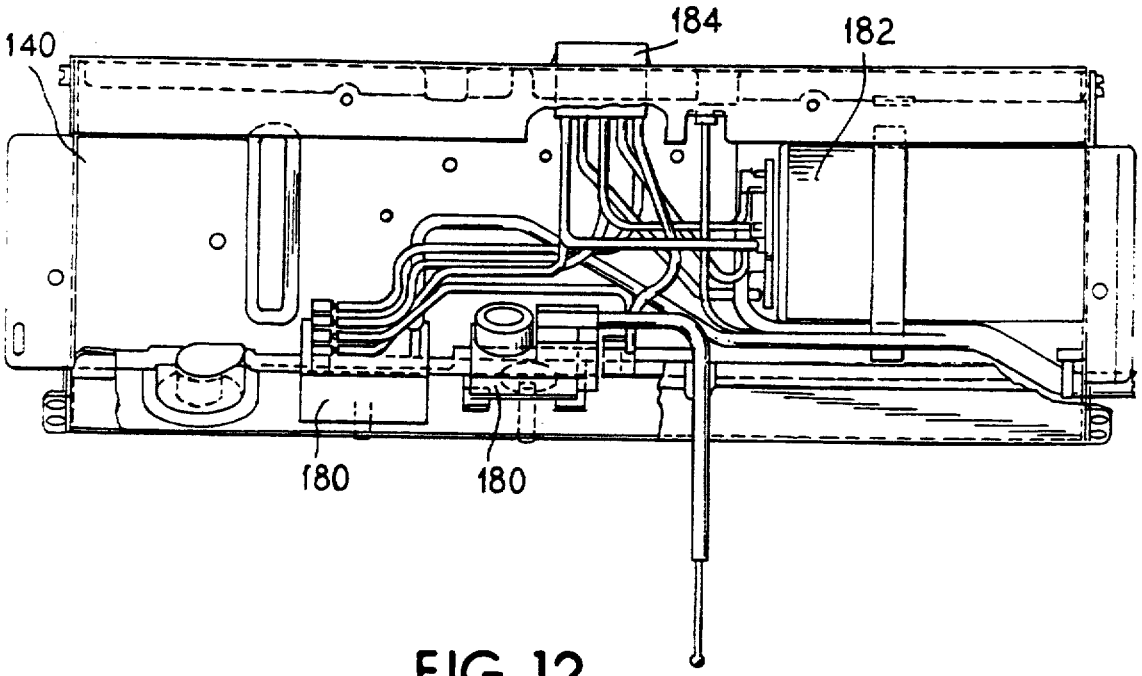
FIG. 11 is a plan view, partially cut away, of the control module assembly.
Figure 12:
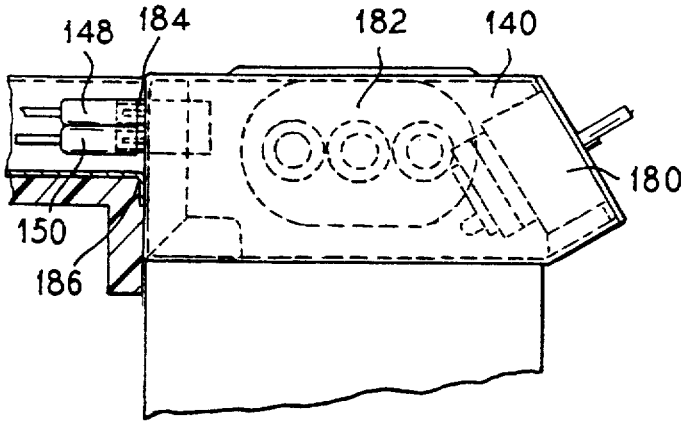
FIG. 12 is a partial side view of the air conditioner assembly illustrating the control module in place.

The control assembly 140 is shown in detail in FIGS. 11 and 12. The control assembly 140 contains all of the electrical switches 180 and other electronic components such as a capacitor 182 and also contains the sockets 184, 186 for receiving the plugs 148, 150 from the wiring harnesses. By combining all of the electrical components into the control assembly 140 the entire set of controls for the air conditioner can be pre-tested prior to assembly into the air conditioner unit thus reducing the steps required for final testing of the air conditioner unit upon complete assembly.

The control assembly 140 is completely enclosed by walls 188 and is completely isolated from any air flow path. Therefore, dirt, dust, water vapor and other contaminants are prevented from continuously flowing over the electrical components and switches i thereby enhancing the life and reliability of the controls.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A one-piece motor mount for an electric motor comprising:

a pair of spaced apart, vertically oriented leg portions;

each leg portion having a broad width extending across substantially a full width of said motor mount in an uninterrupted fashion, and a fixed height;

a foot portion formed at a bottom end of each leg portion;

said foot portions extending horizontally and having openings therethrough for receiving fastening means;

a horizontally oriented saddle portion connecting a top end of said leg portions;

support arm portions extending upwardly from said saddle portion;

each arm portion having a broad width oriented perpendicular to said width of said leg portions and forming an upwardly opening yoke at a top end, said arm portions having a height approximately equal to said height of said leg portions.

2. A one piece motor mount according to claim 1, wherein said foot portions extend outwardly from said leg portions.

3. A one piece motor mount according to claim 1, wherein said motor mount comprises a metal stamping formed from a single metal sheet.

4. A one piece motor mount according to claim 3, wherein said stamping includes strengthening bosses formed in said arm, saddle and leg portions.

5. A one-piece motor mount for an electric motor to be used in a room air conditioner for driving a fan associated with a condenser comprising:

a pair of spaced apart, vertically oriented leg portions;

a foot portion formed at a bottom end of each leg portion;

a horizontally oriented saddle portion connecting a top end of said leg portions;

support arm portions extending upwardly from said saddle portion;

each arm portion having an upwardly opening yoke at a top end thereof to receive said motor;

each arm portion having a height approximately equal to a height of each leg portion; and said spaced apart leg portions providing an unobstructed air flow path beneath said motor into said condenser fan.

6. A one-piece motor mount according to claim 5, wherein each of said leg portions has a broad width and a fixed height.

7. A one-piece motor mount according to claim 5, wherein said foot portions extend horizontally and have openings therethrough for receiving fastening means.

8. A one-piece motor mount according to claim 5, wherein said arm portions have a broad width oriented perpendicular to a width of said leg portions.

9. A one-piece motor mount according to claim 5, wherein said foot portions extend outwardly from said leg portions.

10. A one-piece motor mount according to claim 5, wherein said motor mount comprises a metal stamping formed from a single metal sheet.

11. A one-piece motor mount according to claim 10, wherein said stamping include strengthening bosses formed in said arm, saddle and leg portions.

12. A one-piece motor mount according to claim 5, wherein said yoke includes notched ears for receiving spring clips to secure said motor to said motor mount.

13. A one-piece motor mount for an electric motor comprising:

a pair of substantially vertical legs connected by a central horizontal saddle portion and a pair of substantially vertical arms connected by a central horizontal saddle portion wherein said central saddle portion is common to the legs and arms;

a height of said legs being approximately equal to a height of said arms;

a pair of horizontal feet, each connected to one of said legs;

at least one strengthening boss extending from within each of said feet, through its connected leg and into said saddle portion; and at least one strengthening boss extending from within each of said arms into said saddle portion.

14. A one-piece motor mount according to claim 13, wherein each of said legs has a broad width and each of said arms has a broad width oriented perpendicular to said width of said legs.

15. A one-piece motor mount according to claim 13, wherein said motor mount comprises a metal stamping formed from a single metal sheet.

* * * * *